US006186318B1

(12) United States Patent
Pax et al.

(10) Patent No.: US 6,186,318 B1
(45) **Date of Patent: *Feb. 13, 2001**

(54) ENDLESS BELT COVEYOR UNIT FOR A STAMPING PRESS

(75) Inventors: Francis J. Pax; Steven J. Pax, both of Coldwater, OH (US)

(73) Assignee: Pax Products, Inc., Celina, OH (US)

( * ) Notice: Under 35 U.S.C. 154(b), the term of this patent shall be extended for 0 days.

This patent is subject to a terminal disclaimer.

(21) Appl. No.: 09/312,248

(22) Filed: May 14, 1999

Related U.S. Application Data

(63) Continuation-in-part of application No. 08/746,815, filed on Nov. 18, 1996, now Pat. No. 5,904,240.

(51) Int. Cl.[7] ..... B65G 15/60; B65G 41/00; B21J 13/10; B21D 43/02

(52) U.S. Cl. ..... 198/841; 198/804; 198/300; 198/837; 198/840; 72/421; 72/420

(58) Field of Search ..... 198/841, 837, 198/840, 300, 804, 842; 72/421, 420

(56) References Cited

U.S. PATENT DOCUMENTS

| | | |
|---|---|---|
| 1,847,148 | 3/1932 | Vogeley . |
| 2,962,152 | 11/1960 | Lathrop . |
| 4,013,167 | 3/1977 | Bourgeois . |
| 4,650,067 | 3/1987 | Brule . |

FOREIGN PATENT DOCUMENTS

| | | |
|---|---|---|
| 204722 | 10/1955 | (AU) . |

*Primary Examiner*—Christopher P. Ellis
*Assistant Examiner*—Joe Dillon, Jr.
(74) *Attorney, Agent, or Firm*—Jacox, Meckstroth & Jenkins

(57) ABSTRACT

An elongated low profile sheet metal tray has a bottom panel adapted to seat on the bolster plate of a stamping press under a die set. The panel supports adjacent upper and lower runs of an endless belt directed around guide rollers and a drive roller supported by cast support members removably connected to opposite ends of the tray. A motor and gear reducer unit is mounted on one support member and drives the belt drive roller, and the sheet metal tray has opposite integral side rails forming inclined surfaces and channel portions enclosing opposite edge portions of the belt. A sheet of plastics material extends between the bottom panel and the bottom run of the belt, and a detector senses belt stoppage for stopping the motor and stamping press.

18 Claims, 2 Drawing Sheets

ENDLESS BELT COVEYOR UNIT FOR A STAMPING PRESS

RELATED APPLICATION

This application is a continuation-in-part of application Ser. No. 08/746,815, filed Nov. 18, 1996, U.S. Pat. No. 5,904,240.

BACKGROUND OF THE INVENTION

In the field of stamping presses used for blanking and forming parts from sheet metal, it is common to use endless belt conveyors for removing both the parts produced by a tool and die set installed in the stamping press as well as for removing sheet metal scrap produced by the die set during production of the parts. Jets of compressed air are also commonly used to remove parts from a stamping press. When an endless belt conveyor is used for removing the parts and/or scrap from below a die set, it is known to extend the upper and lower runs of the endless belt beneath the die set with the runs adjacent to each other over the bolster plate of the press. The endless belt is directed around rollers mounted on corresponding shafts supported by bearing brackets mounted on opposite sides of the bolster plate. However, substantial time is required to install such endless belt conveyors on the bolster plate and to mount a motor for driving one of the shafts supporting a drive roller. The endless belts also have a relatively short service life, primarily due to the support of the endless belt and the selection of the belt material.

SUMMARY OF THE INVENTION

The present invention is directed to an improved endless belt conveyor unit which is ideally suited for removing parts and/or scrap from a sheet metal stamping press and which may be quickly and easily installed on the press. The conveyor unit also has a low profile or minimum height under the die set on the press and provides for an extended service life. In addition, the conveyor unit of the invention is durable, and of lightweight modular construction, so that it may be easily manufactured in different lengths and widths. The unit also incorporates a detector for stopping the conveyor and press in the event parts jamb and stop movement of the belt.

In accordance with one embodiment of the invention, the above features and advantages are provided by a conveyor unit including an elongated endless belt having adjacent horizontal upper and lower runs supported by a plastic strip mounted on the bottom panel of a formed sheet metal pan or tray having opposite ends removably connected to cast aluminum support brackets or members. The sheet metal tray has integrally formed opposite side rails which include channel portions enclosing opposite edge portions of the belt. The sheet metal side rails also extend to form inclined surfaces which slope downwardly to the upper run of the belt, and a support member at one end of the tray also supports a drive motor and gear reducer unit for driving a roller engaging the belt. A detector senses rotation of one of the belt guide rollers and is electrically connected to stop the press and the conveyor drive motor in response to a part jamb causing stoppage of the endless belt.

Other features and advantages of the invention will be apparent from the following description, the accompanying drawings and the appended claims.

DESCRIPTION OF THE PREFERRED EMBODIMENT

Figure 1:
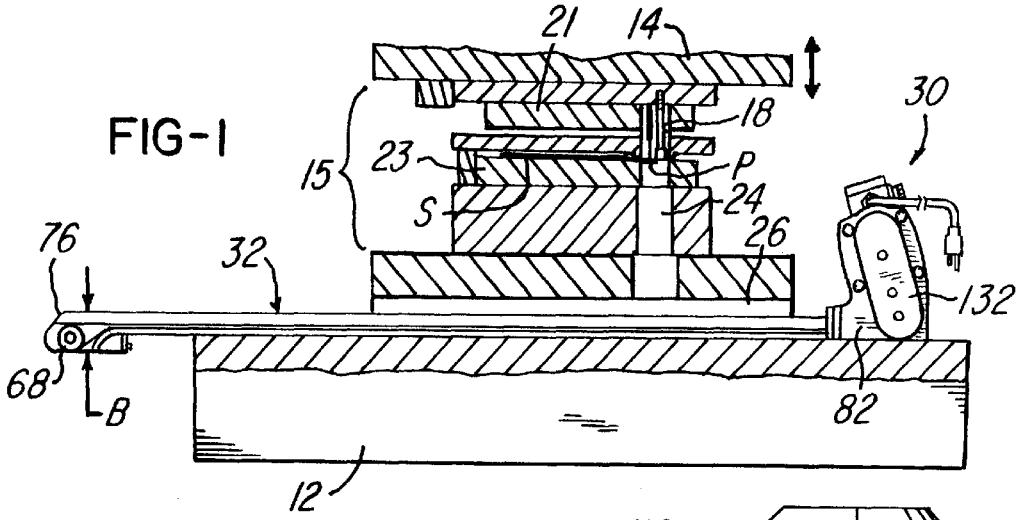
FIG. 1 is generally a side elevational view of a conveyor unit constructed in accordance with the invention and illustrating it installed under a die set on the bolster plate of a stamping press.

Referring to FIG. 1, a sheet metal stamping press includes a horizontal bolster plate 12 and a vertically moveable slide 14 on which are mounted tooling in the form of a die set 15. Typically, the die set 15 includes at each tooling station a punch 18 which blanks and/or forms a part P from a sheet S of metal fed in successive steps into the die set between an upper die shoe member 21 and a lower die shoe member 23. Each blanked or formed part P drops downwardly through a passage 24 and into an inverted channel 26 formed within the bottom surface of the die set 15 above the bolster plate 12. The press components and die set are only generally illustrated in FIG. I and may be constructed in any form for producing a part at each tooling station for discharge through a corresponding passage 24.

Figure 4:
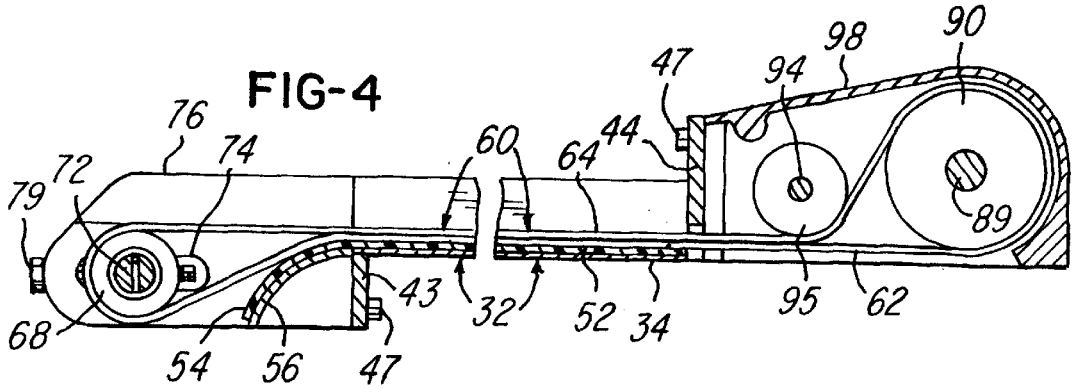
FIG. 4 is a section taken generally on the line 4—4 of FIG. 2.
Figure 5:
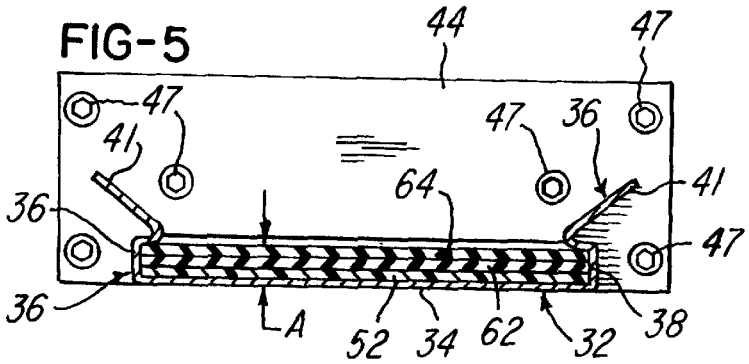
FIG. 5 is a cross section taken generally on the line 5—5 of FIG. 3.

In accordance with the present invention, a portable conveyor unit 30 is adapted to be quickly and easily installed on the bolster plate 12 and extends through the channel 26 under one or more tooling stations, as shown in FIG. 1. The conveyor unit 30 includes an elongated generally flat pan or tray 32 which is formed by bending a sheet of metal or stainless steel to form a flat bottom panel 34 (FIG. 5). The metal sheet extends laterally to form longitudinally extending integral side rails 36 each having a channel portion 38 and an upwardly and outwardly projecting inclined portion 41. A set of end plates 43 and 44 (FIG. 4). are attached or welded to opposite ends of the tray 32, and each plate has a set of holes for receiving corresponding machine screws 47.

An elongated sheet or strip 52 (FIGS. 4 & 5) of a plastics material, such as polyethylene, covers the bottom panel 34 of the tray 32 and has a downwardly curved outer end portion 54 (FIG. 4) which is supported by a curved sheet metal panel 56 extending from the bottom panel 34. An endless conveyor belt 60 includes a lower run 62 (FIG. 5) supported by the adjacent plastic strip 52 and an adjacent upper run 64 supported by the lower run 62. Preferably, the endless belt 60 is constructed of woven polyester material and is commercially available.

At one end or the discharge end of the conveyor unit 30, the belt 60 is directed around a guide roller 68 which is supported for rotation by a set of needle bearings 69 (FIG. 2) mounted on a cross shaft 72. The opposite end portions of the shaft 72 project into corresponding slots 74 formed within a pair of cast aluminum support members or brackets 76. The roller support brackets 76 have opposing arcuate grooves for receiving opposite end portions of the curved plate 56 and also have threaded holes for receiving the screws 47 which removably secure the brackets 76 to the adjacent end plate 43 welded to the tray 32. A pair of belt tension screws 79 extend horizontally through corresponding holes within the cast support members 76 and engage threaded holes within the opposite end portions of the shaft 72 for adjusting the tension within the endless belt 60. The curved metal panel 56 and the overlying portion 54 of the plastics sheet 52 may be replaced by an idler or guide roller located adjacent the end plate 43 to minimize friction on the belt 60.

Figure 2:
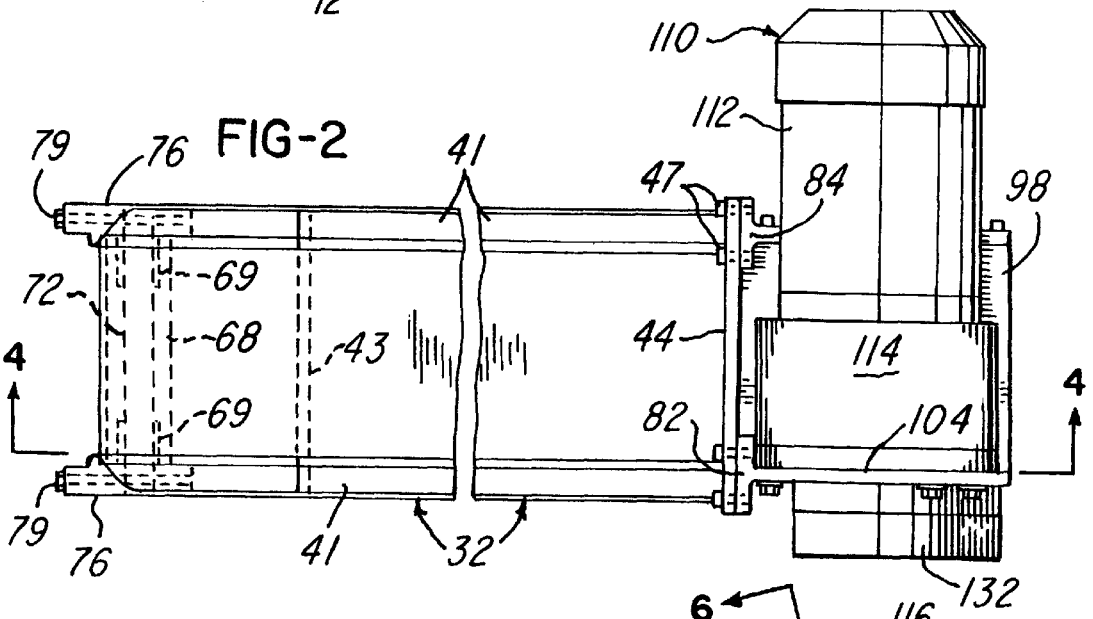
FIG. 2 is an enlarged plan view of the conveyor unit shown in FIG. 1 and with a center portion broken away.

The plate 44 on the opposite end of the tray 32 is connected by a set of the bolts 47 to a set of cast aluminum support members or brackets 82 and 84 (FIG. 2). The brackets retain a set of needle bearings 86 (FIG. 6) which rotatably support the shaft 89 of a drive roller 90 around which is directed the corresponding end portion of the endless belt 60. The brackets 82 and 84 also confine another set of anti-friction or needle bearings (not shown) which support a shaft 94 (FIG. 4) of another guide roller 95, as shown in FIG. 4. The rollers 90 and 95 and the corresponding end portion of the belt 60 are covered by an extruded aluminum cover member 98 (FIG. 4) having opposite ends secured to the support members or brackets 82 and 84 by a set of screws 101 (FIG. 7). As also shown in FIGS. 4 and 6, the brackets 82 and 84 and the cover member 98 have coplanner bottom surfaces which are flush with the bottom surface of the panel 34 of the tray 32 so that the panel 34 and brackets seat on the bolster plate 12.

Figure 3:
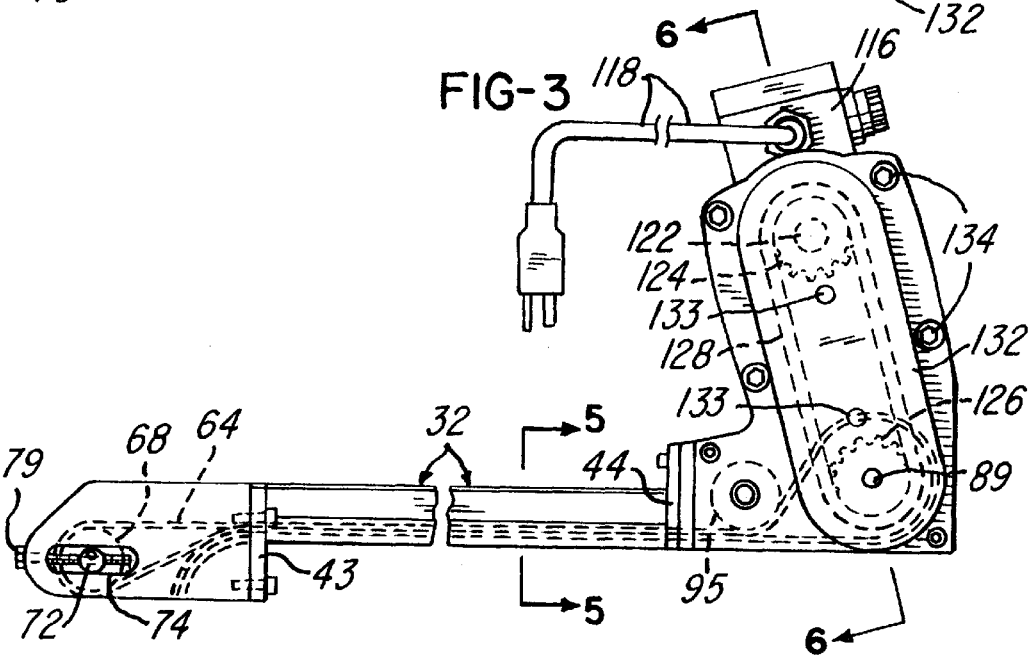
FIG. 3 is a side elevational view of the conveyor unit shown in FIG. 2 with a center portion broken away.
Figure 6:
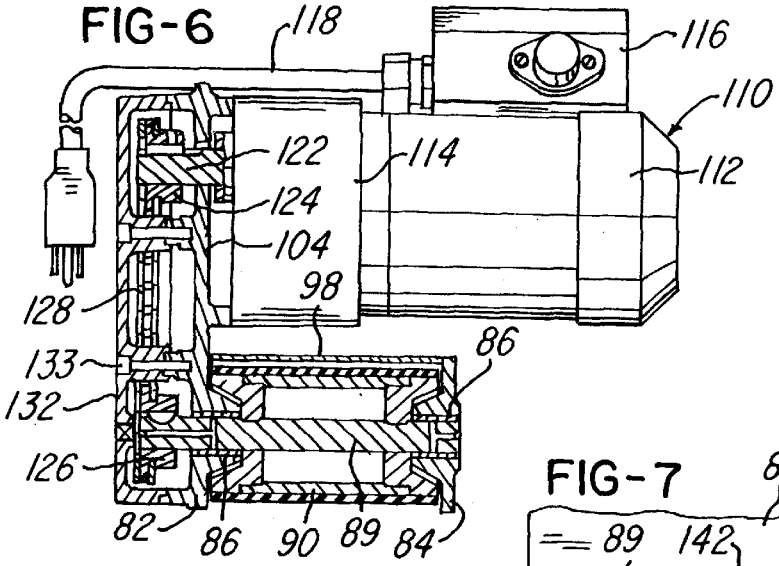
FIG. 6 is a section and part elevation view taken generally on the line 6—6 of FIG. 3.
Figure 7:
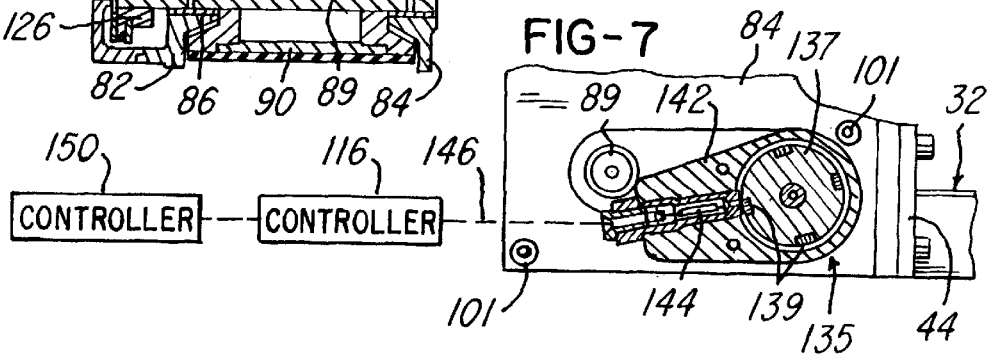
FIG. 7 is a fragmentary section of the conveyor unit and illustrating a belt movement detector for controlling the stamping press and the conveyor drive motor.

Referring to FIG. 6, the cast aluminum member or bracket 82 includes a portion 104 which projects upwardly from the cover member 98 and supports, in a cantilevered manner, a belt drive unit 110 including an electric motor 112 coupled to a gear reducer 114. The motor 112 has a controller 116 which receives electrical current through an electrical or power supply cord 118. The motor 112 drives the gear reducer 114 which has an output shaft 122 connected by a set of sprockets 124 and 126 and an endless chain 128 to a projecting end portion of the shaft 89 for the belt drive roller 90. The chain and sprockets are-enclosed by an outer member 132 (FIGS. 3 and 6) which is removably secured to the bracket 82 by a set of screws 133. Another set of screws 134 (FIG. 3) secure the drive unit 110 to the bracket portion 104.

Referring to FIG. 7, a belt motion detector unit 135 is mounted on the outer surface of the support bracket 84. The unit 135 includes a rotor 137 which is mounted on a projecting end portion of the shaft 94 and has four peripherally spaced permanent magnets 139. A housing 142 surrounds the rotor 137 and supports a reed switch 144 which senses or detects the passing of each magnet 139 when the shaft 94 and rotor 137 are rotating to open and close the switch 144. An electrical conductor or line 146 connects the switch 144 to the controller 116 for the motor 112 and also to a controller 150 for the stamping press. In the event the belt 60 stops, for example, by a jamming of parts on the upper belt run 64 within the channel 26 in the die set 15, the switch 144 detects no rotation of the guide roller 95 and the rotor 137 immediately and stops the conveyor drive motor 112 through the controller 116 and stops the press through the controller 150.

From the drawings of the above description, it is apparent that a conveyor unit constructed in accordance with the invention, provides desirable features and advantages. For example, the assembled thickness A (FIG. 5) of the tray panel 34, plastic strip 52 and conveyor runs 62 and 64 is less than ¾ inch and preferably about ⅜ inch. This minimizes the height of the conveyor portion within the channel 26 of the die set 15 and thereby permits the forming of deeper or taller parts by the die set. In addition, the height B (FIG. 1) of the cast support members or brackets 76 at the discharge end portion of the conveyor unit is approximately 2½ inches. This permits the conveyor unit 30 to be easily and quickly installed under a die set having a channel 26 with a height as small as 2½ inches and in the position on the bolster plate, as shown in FIG. 1.

The modular construction of the conveyor unit 30 also permits construction of the conveyor unit in different lengths simply by constructing different length trays 32 and different length endless belts 60. The opposite end portions of the conveyor unit remain the same regardless of the length of the tray 32 which may be quickly and conveniently coupled to the end portions by the screws 47. Thus the construction of the conveyor unit. 30 permits manufacturing of the conveyor unit in various lengths, for example, between 4' and 8' simply by making endless belts 60 and trays 32 of different lengths.

The conveyor unit 30 may also be economically manufactured in different widths, for example, from 4 inches to 14 inches, simply by making the sheet metal tray 32, endless belt 60, rollers 68, 90 and 95 and their support shafts in different lengths along with the laterally extending support members such as the plates 43 and 44 and members 56 and 98. It is also apparent from FIG. 5 that the opposing channel portions 38 of the sheet metal tray 32 enclose and protect the corresponding edge portions of the endless belt 60. In addition, the side rails 36 of the sheet metal tray provide inclined surfaces which slope downwardly to the upper run 64 of the belt 60 to assure that all parts are received for transport by the upper run 64 of the belt. It is also apparent that the drive end portion of the unit 30, including the brackets 84 and 104, motor 110 and gear reducer 114, may be inverted on the end plate 44 so that the drive projects downwardly from the tray 32 and belt 60 and may be positioned at either end of the bolster plate 12.

While the form of conveyor apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. A conveyor unit adapted for removing parts and/or scrap from a stamping press, comprising an elongated tray including a bottom panel and longitudinally extending side rails, an endless flexible belt having opposite edge portions and an upper run and a lower run extending above said bottom panel, a set of belt engaging rollers supported for rotation by support members connected to opposite ends of said tray and positioned for directing both of said runs of said belt in close proximity to each other and in close proximity to said bottom panel of said tray for substantially minimizing the combined thickness of said conveyor runs and said trays, said side rails of said tray extending around and confining said edge portions of said upper and lower runs, a drive unit mounted on one of said support members for driving one of said rollers, and the assembled said belt, tray, support members, rollers and drive unit providing for convenient installation and use of said conveyor unit.

2. A conveyor unit as defined in claim 1 wherein said tray comprises a formed sheet of metal with integrally formed said side rails, a set of mounting plates rigidly secured to opposite ends of said tray, and means removably connecting said mounting plates to said support members for said rollers.

3. A conveyor unit as defined in claim 1 wherein said tray comprises a formed sheet of metal extending to form integral said side rails, said side rails including longitudinally extending sheet metal channel portions receiving said edge portions of said belt, and said side rails forming inclined surfaces sloping downwardly to said upper run of said belt.

4. A conveyor unit as defined in claim 1 wherein said one support member supporting said drive unit has a bottom surface substantially coplanar with a bottom surface of said tray.

5. A conveyor unit as defined in claim 1 and including a sheet of plastics material mounted on said bottom panel of said tray between said side rails and below said bottom run of said belt.

6. A conveyor unit as defined in claim 1 and including belt guide means directing said belt from said tray around one of said rollers.

7. A conveyor unit as defined in claim 1 and including a detector for sensing movement of said belt and connected to stop said drive unit and the stamping press in response to stopping of said belt.

8. A conveyor unit as defined in claim 1 wherein a first of said support members and a corresponding said roller at a discharge end of said tray project downwardly from said tray.

9. A conveyor unit as defined in claim 1 wherein one of said support members and said drive unit project in one direction from said tray.

10. A conveyor unit adapted for removing parts and/or scrap from a stamping press, comprising an elongated tray including a bottom panel and longitudinally extending side rails, an endless flexible belt having opposite edge portions and an upper run and a lower run extending above said bottom panel, a set of belt engaging rollers supported for rotation by support members connected to opposite ends of said tray and positioned for directing both of said runs of said belt in close proximity to each other and in close proximity to said bottom panel of said tray for substantially minimizing the combined thickness of said conveyor runs and said tray, said side rails of said tray extending adjacent said edge portions of said upper and lower runs, an electric motor and gear reducer drive unit mounted on one of said support members and connected to drive one of said rollers, and the assembly of said belt, tray, support members, rollers and drive unit providing for convenient installation and use of said conveyor unit.

11. A conveyor unit as defined in claim 10 wherein said tray comprises a formed sheet of metal with integrally formed said side rails, a set of mounting plates rigidly secured to opposite ends of said tray, and means removably connecting said mounting plates to said support members for said rollers.

12. A conveyor unit as defined in claim 10 wherein said tray comprises a formed sheet of metal extending to form integral said side rails, said side rails including longitudinally extending sheet metal channel portions receiving said edge portions of said belt, and said side rails forming inclined surfaces sloping downwardly to said upper run of said belt.

13. A conveyor unit as defined in claim 10 wherein said one support member supporting said drive unit has a bottom surface substantially coplanar with a bottom surface of said tray.

14. A conveyor unit as defined in claim 10 and including a sheet of plastics material mounted on said bottom panel of said tray between said side rails and below said bottom run of said belt.

15. A conveyor unit as defined in claim 10 and including belt guide means directing said belt from said tray around one of said rollers.

16. A conveyor unit as defined in claim 10 and including a detector for sensing movement of said belt and connected to stop said drive unit and the stamping press in response to stopping of said belt.

17. A conveyor unit as defined in claim 10 wherein a first of said support members and a corresponding said roller at a discharge end of said tray project downwardly from said tray.

18. A conveyor unit as defined in claim 10 wherein one of said of said support members and said drive unit project in one direction from said tray.

* * * * *